United States Patent [19]

Kawai et al.

[11] Patent Number: 4,608,766

[45] Date of Patent: Sep. 2, 1986

[54] HORIZONTAL FLUIDIZED-BED DRYER WITH HEAT TRANSFER TUBES

[75] Inventors: Sumio Kawai; Kazumasa Nagasawa, both of Shizuoka; Kazuo Kishihata, Shimada, all of Japan

[73] Assignee: Kabushiki Kaisha Okawara Seisakusho, Shiauoka, Japan

[21] Appl. No.: 740,023

[22] Filed: May 31, 1985

[30] Foreign Application Priority Data

Jun. 18, 1984 [JP] Japan ..... 59-125829

[51] Int. Cl.[4] ..... F26B 17/18

[52] U.S. Cl. ..... 34/57 A; 34/57 R; 34/179; 34/181

[58] Field of Search ..... 34/57 R, 57 A, 57 D, 34/179, 180, 181

[56] References Cited

U.S. PATENT DOCUMENTS

| | | | |
|---|---|---|---|
| 504,099 | 8/1893 | Wiesebrook | 34/179 |
| 2,302,169 | 11/1942 | Baker | 34/57 D |
| 2,509,543 | 5/1950 | Truax | 34/180 |
| 3,242,974 | 3/1966 | Gouloumes | 34/57 A |
| 3,585,732 | 6/1971 | Itahashi | 34/57 A |
| 3,646,689 | 3/1972 | Kuchenthal et al. | 34/57 D |
| 3,851,406 | 12/1974 | Dumitru et al. | 34/57 R |
| 3,908,284 | 9/1975 | Beranek et al. | 34/57 A |
| 3,923,097 | 12/1975 | Hovad | 34/179 |
| 4,419,834 | 12/1983 | Scott | 34/57 D |

*Primary Examiner*—Albert J. Makay
*Assistant Examiner*—David W. Westphal
*Attorney, Agent, or Firm*—Bucknam and Archer

[57] ABSTRACT

In a horizontal fluidized-bed dryer, at least one rotatable hollow axle extends horizontally through a drying chamber over a porous supporting shelf and has a heat transfer tube assembly mounted on and around the hollow axle for fluid communication therewith. A spiral or screw-shaped blade is mounted on the heat transfer tube assembly so as to be disposed around the periphery of an imaginary cylindrical figure generated by rotation of the heat transfer tube assembly about the hollow axle. This blade serves to push large particles of wet feed on the supporting shelf from the inlet side to the outlet side as the hollow axle and thus the heat transfer tube assembly are rotated.

6 Claims, 7 Drawing Figures

HORIZONTAL FLUIDIZED-BED DRYER WITH HEAT TRANSFER TUBES

BACKGROUND OF THE INVENTION

1. Field of the Invention

The present invention relates to dryers, and more particularly to a horizontal fluidized-bed dryer having built-in heat transfer tubes.

2. Prior Art

Various horizontal fluidized-bed dryers are known in which wet feed or material to be dried is fluidized in a drying chamber as the wet feed is continuously moved from an inlet side to an outlet side over a porous supporting shelf through which heated air is blown upwardly into the drying chamber. Ideally, it be required that wet feed is in the form of powder in which the individual particles vary in size within a specified range. Practically, however, wet feed is composed of particles which vary in size widely beyond such a specified range, including particles too large to be fluidized. Since such large particles would stay on the supporting shelf so as to close up some of the through-openings therein, circulation of heated air in the drying chamber would be hindered. As a consequence, continuous and efficient drying operation has been difficult to achieve.

To this end, one solution has been proposed by Japanese Patent Publication (Kokoku) No. 48-38495 in which, as illustrated in FIG. 1 of the accompanying drawings, a supporting shelf 12 extends horizontally in a drying chamber 11 and has a multiplicity of through-openings, all inclined in a common direction to deflect the flow of heated air through the shelf 12 so that the large particles are blown progressively from the side of an inlet 13 toward an outlet 14. Although it requires no special mechanism, this prior dryer is useful only under the condition that wet feed does not contain any particle that is larger than a predetermined size.

Another attempt has been proposed by Japanese Patent Publication (Kokoku) No. 50-3225 in which, as illustrated in FIG. 2, a scraper 15 is mounted in the drying chamber 11 in order to push large particles of the wet feed on the supporting shelf 12 toward the outlet 14. With this arrangement, it is possible to discharge the large particles out of the drying chamber with accuracy, irrespective of the size and amount of the large particles. However, since the scraper 15 occupies the major area just over the supporting shelf 12, it is impossible to furnish heat transfer tubes or other parts in that area.

SUMMARY OF THE INVENTION

In a horizontal fluidized-bed dryer according to the present invention, at least one rotatable hollow axle extends horizontally through a drying chamber over a porous supporting shelf and has a heat transfer tube assembly mounted on and around the hollow axle for fluid communication therewith. A spiral or screw-shaped blade is mounted on the heat transfer tube assembly so as to be disposed around the periphery of an imaginary cylindrical figure generated by rotation of the heat transfer tube assembly about the hollow axle. This blade serves to push large particles of wet feed on the supporting shelf from the inlet side to the outlet side as the hollow axle and thus the heat transfer tube assembly is rotated.

It is therefore an object of the present invention to provide a horizontal fluidized-bed dryer by which large particles as well as small particles of wet feed can be dried, without the risk of reducing the drying efficiency.

Many other advantages, features and additional objects of the present invention will become manifest to those versed in the art upon making reference to the detailed description and the accompanying drawings in which certain preferred embodiments incorporating the principles of the present invention are shown by way of illustrative example.

DETAILED DESCRIPTION

Figure 1:
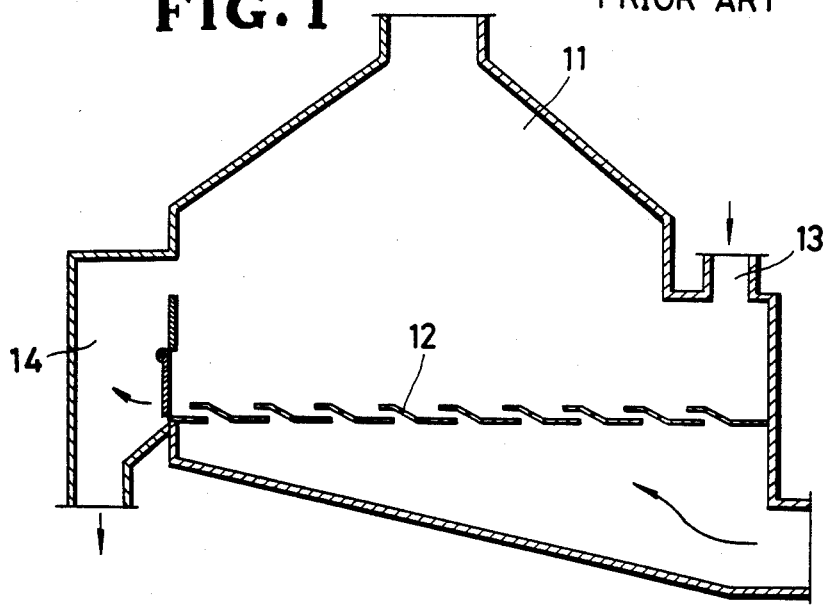
FIG. 1 PRIOR ART
FIGS. 1 and 2 are vertical cross-sectional views of prior horizontal fluidized-bed dryers.
Figure 2:
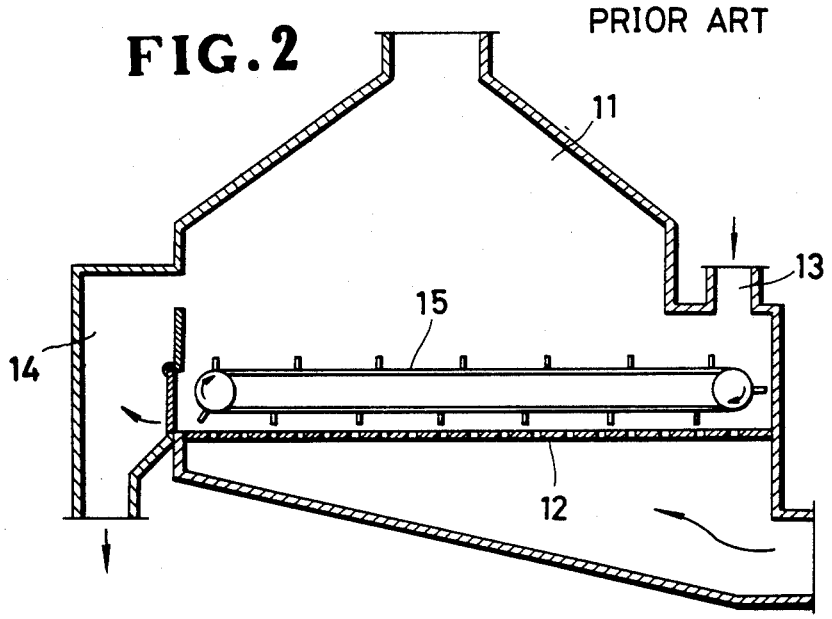
FIG. 2 PRIOR ART
Figure 3:
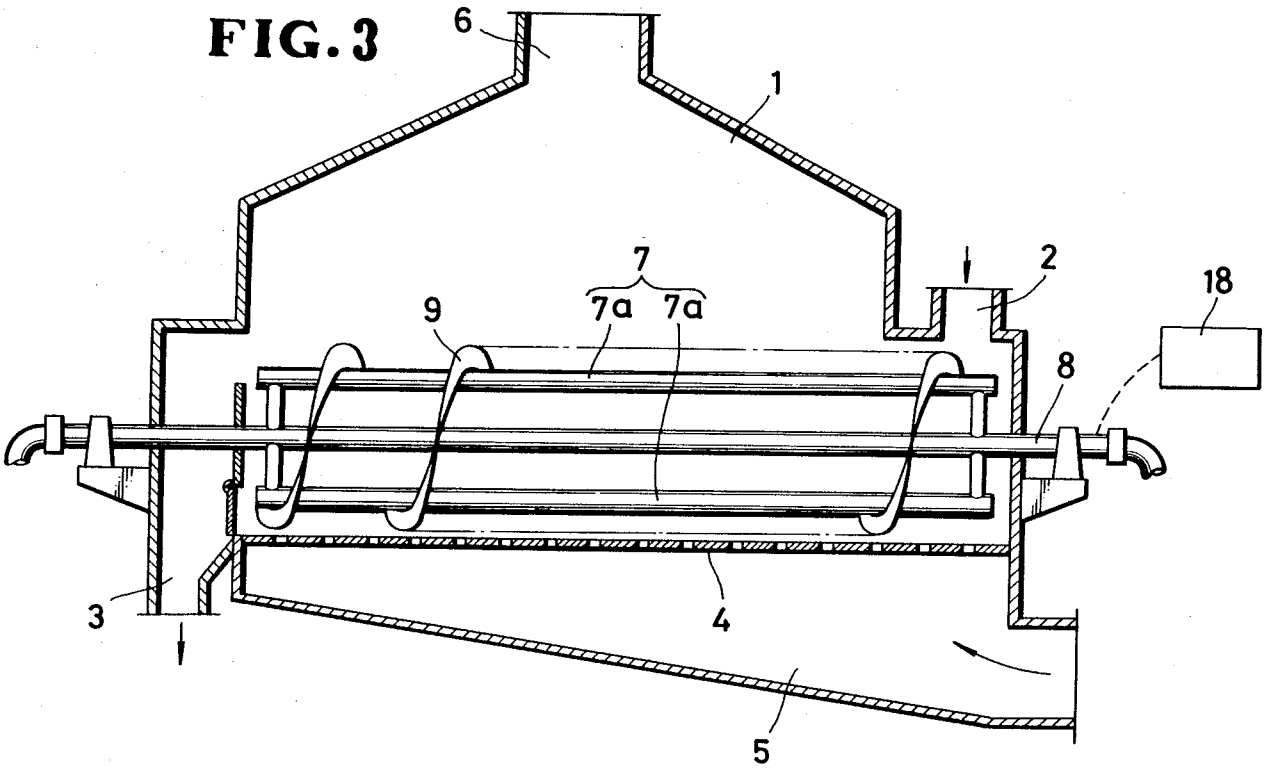
FIG. 3 is a vertical cross-sectional view of a horizontal fluidized-bed dryer embodying the present invention.
Figure 4A:
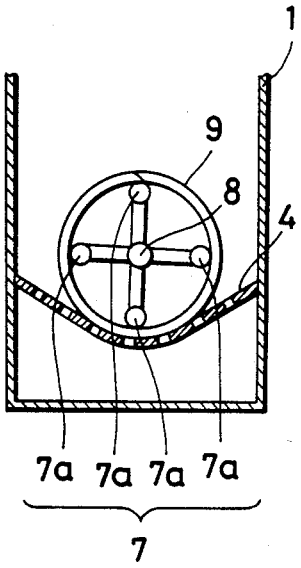
FIG. 4A is a cross-sectional side view of FIG. 3, showing a single heat-transfer-tube assembly.

The principles of the present invention are particularly useful when embodied in a horizontal fluidized-bed dryer (hereinafter called "dryer") such as shown in FIGS. 3 and 4A.

The dryer includes a horizontal drying chamber 1 having at one end an inlet 2 from which wet feed or material (not shown) is introduced into the drying chamber 1 and at the other end an outlet 3 from which the dried material (not shown) is discharged out of the drying chamber 1. The drying chamber 1 also has at a top end thereof an exhaust port 6 from which exhaust air is discharged. A horizontal porous supporting shelf 4 is mounted within the drying chamber 1 at a bottom thereof for preventing the wet feed from falling during drying.

The dryer also includes a heated-air chamber 5 adapted to be connected at one end to a heater and a blower (both not shown) and joined at the other end with the drying chamber 1 for introducing heated air into the drying chamber 1 through the porous supporting shelf 4.

A rotatable hollow axle 8 extends horizontally through the drying chamber 1 over the supporting shelf 4 and has a heat transfer tube assembly 7 mounted on and around the hollow axle 8 for fluid communication therewith. The assembly 7 is composed of four tubes *7a, 7a, 7a, 7a* spaced circumferentially at equal intervals about the hollow axle 8 and extending parallel to the hollow axle 8. Heat medium, such as vapor, is introduced into the hollow axle 8 from one end thereof and then into the heat transfer tube assembly 7, and is finally discharged from the other end of the hollow axle 8. A portion of heat energy of the heat medium is transferred to the wet feed while the heat medium passes through the heat transfer tube assembly 7.

A spiral or screw-shaped blade 9 is mounted on the heat transfer tube assembly 7 in such a fashion that it extends around the periphery of an imaginary cylindrical figure generated by rotation of the heat transfer tube assembly 7 about the hollow axle 8. The screw-shaped blade 9 serves to push large particles of the wet feed on the supporting shelf 4 continuously toward the outlet side (leftside in FIG. 3) as the hollow axle 8 and thus the heat transfer tube assembly 7 are rotated by a suitable drive 18.

As shown in FIG. 4A, the supporting shelf 4 is in the form of a gutter extending parallel to the hollow axle 8. Large particles of the wet feed are moved in and along the gutter of the supporting shelf 4 by the action of the screw-shaped blade 9 as the hollow axle 8 and thus the heat transfer tube assembly 7 are rotated by the drive 18.

Figure 4B:
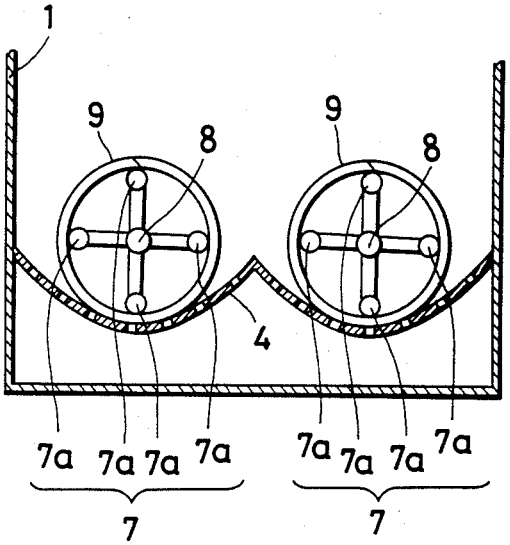
FIG. 4B is a cross-sectional side view of a second embodiment, showing a pair of heat-transfer-tube assemblies.

FIG. 4B illustrates a second embodiment in which a pair of parallel hollow axles 8, 8 is mounted in the drying chamber 1. Each hollow axle 8, like the embodiment of FIG. 4A, has a heat transfer tube assembly 7 with a screw-shaped blade 9 therearound. The supporting shelf 4 is in the form of a double gutter extending parallel to the two hollow axles 8, 8.

Figure 5:
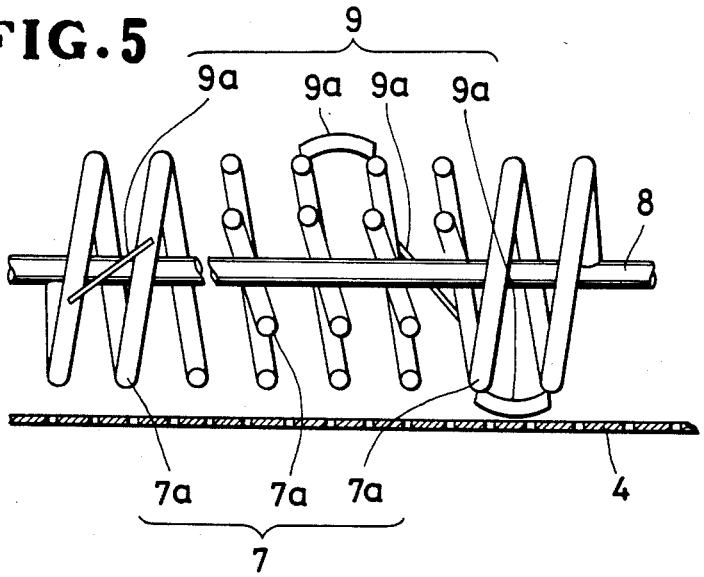
FIGS. 5 and 6 show modified forms of the heat-transfer-tube assembly.

During the drying, large particles of the wet feed must be kept within the drying chamber 1 until they are dried to a predetermined degree. The speed at which large particles of the wet feed are pushed by the blade 9 may vary by changing the configuration of the blade 9 and/or the angle of inclination of the blade 9. In the example of FIG. 5, the blade 9 is in the form of a series of descrete blade segments for moving large particles of the wet feed intermittently, thus causing a prolonged stay of large particles of the wet feed. Further, the heat transfer tube assembly 7 is composed of at least one spiral tube *7a*.

Figure 6:
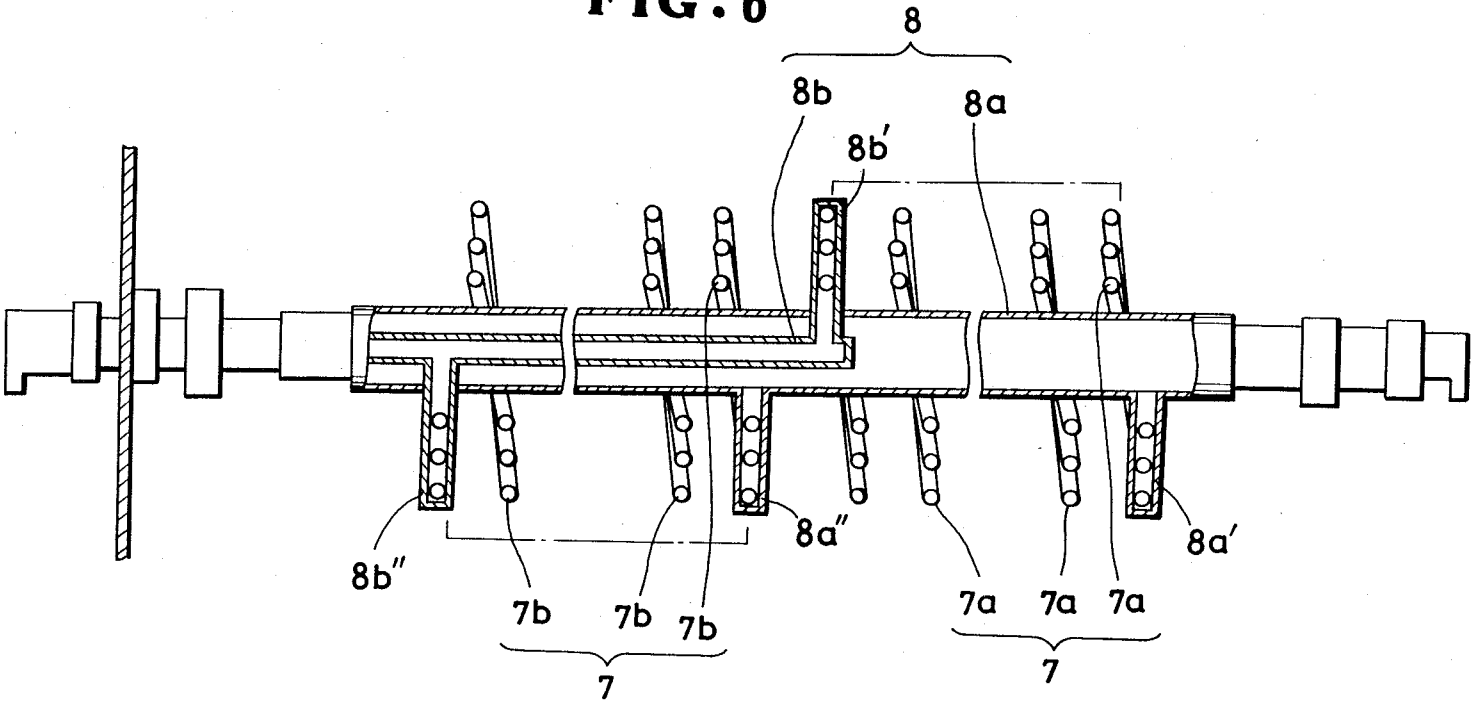

FIG. 6 illustates a third embodiment in which the hollow axle 8 is in the form of a double tube composed of an outer or main tube 8*a* and an inner or auxiliary tube 8*b*. The outer tube 8*a* extends through the entire length of the drying chamber 1, while the inner tube 8*b* extends in the outer tube 8*a* from the outlet end thereof and terminates at a midportion of the outer tube 8*a*. The heat transfer tube assembly 7 is divided into a pair of first and second sections *7a*, *7b*. The first assembly section *7a* extends around the upstream half of the outer tube 8*a* and is connected at one end to the upstream end portion 8*a'* of the outer tube 8*a* and at the other end to the upstream end portion 8*b'* of the inner tube 8*b*. The second assembly section *7b* extends around the downstream half of the outer tube 8*a* and is connected at one end to the midportion 8*a''* of the outer tube 8*a* and at the other end to the downstream end portion 8*b''* of the inner tube 8*b*.

In the embodiment of FIG. 6, heat medium is introduced into the first and second assembly sections *7a*, *7b* from the outer tube 8*a* via the upstream end portion 8*a'* and the midportion 8*a''*, respectively. The heat medium becomes cooled (because its heat energy is partially transferred to the wet feed) as it passes through the respective assembly sections *7a*, *7b*, and the cooled heat medium is then discharged into the inner tube 8*b* via the upstream and downstream end portions 8*b'*, 8*b''* thereof. With this arrangement, heat energy of the heat medium can be transferred to the wet feed uniformly along the entire length of the drying chamber 1. Therefore, this embodiment is particularly advantageous when applied to an elongated horizontal fluidized-bed dryer.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A horizontal fluidized-bed dryer for drying wet feed containing large particles, which comprises:

(a) a horizontal drying chamber having at one end an inlet from which the wet feed is introduced into said drying chamber and at the other end an outlet from which the dried wet feed is discharged from said drying chamber;

(b) a horizontal porous supporting shelf mounted within said drying chamber at the bottom thereof for preventing the wet feed from falling during drying and means for causing an upward air flow through the horizontal porous supporting shelf to cause the feed to be fluidized;

(c) at least one hollow axle extending horizontally through said drying chamber over said supporting shelf for passage of a heating medium and adapted to be driven by a drive for rotation;

(d) a heat transfer tube assembly including at least one spiral tube mounted on and around the respective hollow axle for fluid communication therewith; and (e) a spiral blade mounted on said spiral tube and extending around the periphery of an imaginary cylindrical figure generated by rotation of said spiral tube about said hollow axle, said spiral blade being operable to push the large particles of the wet feed on said supporting shelf progressively toward said outlet when said hollow axle and said spiral tube are rotated by said drive.

2. A horizontal fluidized-bed dryer according to claim 1, wherein said spiral balde comprises a series of discrete blade segments.

3. A horizontal fluidized-bed dryer according to claim 1, wherein said hollow axle includes a double tube composed of an outer tube extending through the entire length of said drying chamber and an inner tube extending in said outer tube from the outlet end thereof and terminating at the midportion of said outer tube, said spiral tube being divided into a pair of first and second sections, said first section extending around the upstream half of said outer tube and being connected at one end to the upstream end portion of said outer tube and at the other end to the upstream end portion of said inner tube, said second section extending around a downstream half to said outer tube and being connected at one end to a midportion of said outer tube and at the other end to a downstream end portion of said inner tube.

4. A horizontal fluidized-bed dryer according to claim 1, wherein said supporting shelf is in the form of at least one gutter extending parallel to the respective hollow axle.

5. A horizontal fluidized-bed dryer according to claim 4, which comprises a pair of hollow axles, each hollow axle has a heat transfer tube, a spiral blade mounted on each transfer tube, said gutter is a double gutter and each gutter has an arcuate upper surface with a curvature smaller than the curvature of each of said blade the center of the curvature of said arcuate upper surface being diposed off the axis of said hollow axis.

6. A horizontal fluidized bed dryer according to claim 4 wherein said gutter has an arcuate upper surface and said arcuate upper surface has a curvature smaller than the curvature of said spiral blade, the center of curvature of said arcuate upper surface being disposed off the axis of said hollow axle.

* * * * *